US009995186B2

(12) United States Patent
Kim et al.

(10) Patent No.: US 9,995,186 B2
(45) Date of Patent: Jun. 12, 2018

(54) METHOD AND SYSTEM FOR RELEASING CATCHING OF LOCKING PIN

(71) Applicants: Hyundai Motor Company, Seoul (KR); Kia Motors Corp., Seoul (KR)

(72) Inventors: Sung Joo Kim, Whasung-Si (KR); Do Geun Jung, Whasung-Si (KR)

(73) Assignees: Hyundai Motor Company, Seoul (KR); Kia Motors Corp., Seoul (KR)

( * ) Notice: Subject to any disclaimer, the term of this patent is extended or adjusted under 35 U.S.C. 154(b) by 348 days.

(21) Appl. No.: 14/661,399

(22) Filed: Mar. 18, 2015

(65) Prior Publication Data

US 2016/0090876 A1 Mar. 31, 2016

(30) Foreign Application Priority Data

Sep. 29, 2014 (KR) ..... 10-2014-0130096

(51) Int. Cl.
*F01L 1/344* (2006.01)
*G05B 15/02* (2006.01)

(52) U.S. Cl.
CPC ... *F01L 1/3442* (2013.01); *F01L 2001/34453* (2013.01)

(58) Field of Classification Search
CPC ..... F01L 1/3442; F01L 2001/34453
See application file for complete search history.

(56) References Cited

U.S. PATENT DOCUMENTS

| | | | | |
|---|---|---|---|---|
| 6,386,164 | B1 * | 5/2002 | Mikame | F01L 1/3442 123/90.17 |
| 6,491,009 | B1 * | 12/2002 | Schmaler | F01L 1/3442 123/90.17 |
| 7,565,888 | B2 * | 7/2009 | Sawdon | F01L 1/3442 123/90.15 |
| 2010/0023242 | A1 * | 1/2010 | Kawamura | F01L 1/3442 701/103 |
| 2011/0100312 | A1 * | 5/2011 | Hirata | F01L 1/022 123/90.17 |
| 2014/0069363 | A1 * | 3/2014 | Yamaguchi | F01L 1/3442 123/90.17 |

FOREIGN PATENT DOCUMENTS

| | | | | |
|---|---|---|---|---|
| JP | 410037989 | A * | 7/1996 | F16D 63/00 |
| JP | 2001-41012 | A | 2/2001 | |
| JP | 2001-152883 | A | 6/2001 | |
| JP | 2001-227308 | A | 8/2001 | |

(Continued)

*Primary Examiner* — Kenneth M Lo
*Assistant Examiner* — Chad Erdman
(74) *Attorney, Agent, or Firm* — Morgan, Lewis & Bockius LLP

(57) ABSTRACT

A method for releasing a catching of a locking pin may include a control application step of releasing the locking pin from a locking pin hole by an electronic control unit (ECU) so that a catching phenomenon of the locking pin due to friction force into a rotation direction of a cam is prevented, and a cam shaking prevention control logic alternately performing, by the ECU, a holding control stopping a rotation of the cam and a rotation control of the cam into a target direction so that it is prevented that the cam is rotated in a direction which is opposite to a rotation target direction of the cam when the releasing of the locking pin is completed.

12 Claims, 5 Drawing Sheets

(56) References Cited

FOREIGN PATENT DOCUMENTS

| | | | | | |
|---|---|---|---|---|---|
| JP | 2005-146922 | | * | 9/2005 | ..... F01L 1/34 |
| JP | 2005-264764 | A | | 9/2005 | |
| JP | 2006-220154 | A | | 8/2006 | |
| JP | 2011-012576 | A | | 1/2011 | |
| KR | 10-0406777 | B1 | | 11/2003 | |
| KR | 10-2014-0021341 | A | | 2/2014 | |

* cited by examiner

METHOD AND SYSTEM FOR RELEASING CATCHING OF LOCKING PIN

CROSS REFERENCE TO RELATED APPLICATION

The present application claims priority to Korean Patent Application Number 10-2014-0130096 filed Sep. 29, 2014, the entire contents of which is incorporated herein for all purposes by this reference.

BACKGROUND OF THE INVENTION

Field of the Invention

The present invention relates to a method and a system for releasing a catching of a locking pin, and more particularly, to a method and a system for releasing a catching of a locking pin for solving a problem that a continuous variable valve timer (CVVT) itself including a cam shakes since the locking pin is actually loosed from a locking pin hole during a process of performing a control logic for releasing the locking pin in the case in which the locking pin is caught with the locking pin hole, and as a result, when the releasing is completed, a cam is rotated in a direction which is opposite to a direction in which the cam originally intends to be rotated.

Description of Related Art

In order to assist in understanding the present invention, a locking pin of a CVVT will be first described as follows.

In general, the CVVT is a system of continuously changing an open or close timing of a valve by changing a phase of a cam shaft depending on an RPM of engine and a load state of a vehicle.

The continuous variable valve timer 101 of a vehicle according to the related art generally includes a crank angle sensor sensing a rotation angle of a crank shaft, a cam angle sensor sensing a rotation angle of a cam shaft 104, a variable valve timing unit 150 connected to one side of the cam shaft 104 by a timing belt and advancing or retarding the cam shaft 104, and an electronic control unit (ECU) controlling an oil control valve 108 so as to supply oil to an advance chamber 111*a* or a retard chamber 111*b* of the variable valve timing unit 150 based on signals of the crank angle sensor and the cam angle sensor, as shown in FIG. 1.

The variable valve timing unit 150 includes a stator 110 connected to the crank shaft by the timing belt so as to receive rotational force of the crank shaft, and a rotor 120 of a vane shape which is integrally coupled to the cam shaft 104 and is rotated relative to the stator 110.

The stator 110 is provided with a chamber 111 which is divided into the advance chamber 111*a* and the retard chamber 111*b* by the rotor 120. If the oil is supplied to the advance chamber 111*a* through an oil control valve 108, a phase difference is generated between the rotor 120 and the stator 110 and the cam shaft 104 is rotated, thereby changing a timing of the valve.

Of course, if the oil is introduced into the retard chamber 111*b* through the oil control valve 108, a phase difference is generated between the rotor 120 and the stator 110 in a direction opposite to that described above, thereby retarding the timing of the valve.

The rotor 120 is provided with a locking pin 131 so that the rotor 120 is wound around the stator 110 when the engine is stopped, and the stator 110 is provided with a pin catching part (not shown) with which the locking pin 131 is caught.

However, in the continuous variable valve timer 101 according to the related art as described above, when the engine is stopped, the locking pin 131 may not be properly caught with the pin catching part, or may not be moved by a physical constraint even though using an electronic control, or may be stuck by surrounding foreign materials.

Meanwhile, in order to electronically control an operation of a lock/unlock for a locking pin hole formed in the rotor of the locking pin, the ECU controls the operation of the lock/unlock while switching on/off power of a solenoid valve.

However, if the cam is operated before the locking pin is completely loosed from the locking pin hole, the locking pin is physically caught with peripheral devices of the locking pin or is stuck by the foreign materials, and consequently the locking pin may not be loosed. As such, in the case in which the locking pin is not loosed, since the CVVT is not operated and a position of the cam does not smoothly follow a set target value, an engine warning light is turned on due to the following defect. As a result, the driver should go to a repair shop for directly receiving an after service.

A state showing a problem in which the locking pin is caught with the locking pin hole formed in the rotor of the locking pin is shown in FIG. 2.

As shown in FIG. 2A and FIG. 2B, after the locking pin 131 is released from the locking pin hole by being moved to a lower direction of the locking pin hole, the control of the CVVT is first performed and the locking pin should be rotated in an advance direction or a retard direction. However, in the case in which the control of the CVVT is first performed by supplying the oil to the oil control valve before the locking pin 131 is released, since side rotational force (side force) by force trying to rotate is greater than unlock force which is downward force of the locking pin, the locking pin is not released.

Consequently, as described above, in the case in which the locking pin is not loosed, since the CVVT is not operated and a position of the cam does not smoothly follow a set target value, an engine warning light is turned on due to the following defect. As a result, the driver should go to a repair shop for directly receiving an after service.

In order to solve the above-mentioned problems, there is a method in which the locking pin is released by canceling 'side force' while shaking the CVVT in the advance or retard direction. However, as shown in FIG. 3, the CVVT may shake in a direction which is opposite to a target direction of the CVVT as shown in 'A' in the instant at which the locking pin is actually released.

Therefore, various aspects of the present invention are directed to providing a method and a system for releasing a catching of a locking pin capable of preventing the CVVT itself including the cam from being shaken by rotating the CVVT in a direction which is opposite to the target direction of the CVVT even in the instant at which the locking pin is actually released.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a method and a system for releasing a catching of a locking pin capable of preventing a problem that a CVVT or a cam is shaken by being rotated in a direction which is opposite to a rotation target direction when a locking pin is actually released by alternately performing a releasing control of the locking pin, and a holding control stopping a rotation of the cam and a rotation control rotating the cam in a rotation target direction at the same time in order to solve the problem that the CVVT or the cam is shaken by rotating the cam in the direction which is opposite to the rotation target direction in the instant at which the locking pin is released from a locking pin hole.

According to various aspects of the present invention, a method for releasing a catching of a locking pin may include a control application step of releasing the locking pin from a locking pin hole by an Electronic Control Unit (ECU) so that a catching phenomenon of the locking pin due to friction force into a rotation direction of a cam is prevented, and a cam shaking prevention control logic alternately performing by the ECU a holding control stopping a rotation of the cam and a rotation control of the cam into a target direction so that it is prevented that the cam is rotated in a direction which is opposite to a rotation target direction of the cam when the releasing of the locking pin is completed.

The cam shaking prevention control logic may include a direction searching step of searching the rotation target direction of the cam, a locking pin friction force removing step of alternately performing the holding control and the rotation control by a set period value, and a step of controlling the cam in the rotation target direction of the cam.

In the locking pin friction force removing step, the holding control may stop the rotation of the cam by not applying a duty value rotating the cam.

In the locking pin friction force removing step, the rotation control may apply a set duty value so that the cam is rotated in the rotation target direction of the cam.

The set duty value may be smaller than a target duty value which is set to rotate the cam in the rotation target direction of the cam.

The set duty value may have an applied duty value which is gradually decreased until the locking pin is released from the locking pin hole.

The method may further include, after the locking pin friction force removing step, a locking pin releasing determining step of determining that the releasing of the locking pin is completed in the case in which a difference between a position of a current cam and a position of a cam is greater than a set reference value.

According various aspects of the present invention, a system for releasing a catching of a locking pin may include a locking pin releasing device applying a signal releasing the locking pin, and a switching controlling device alternately performing a releasing control by the locking pin releasing device, and a control stopping a rotation of a cam and a control applying a set duty value in a rotation target direction of the cam at the same time.

The switching controlling device may search the rotation target direction of the cam, alternately perform the control stopping the rotation of the cam and the control applying the set duty value in the rotation target direction of the cam by a set period value, and then apply a signal rotating the cam in the rotation target direction of the cam after the locking pin is released.

The switching controlling device may not apply a duty value rotating the cam upon the control stopping the rotation of the cam.

The switching controlling device may alternately apply a duty value smaller than the target duty value applied in the rotation target direction of the cam together with the control stopping the rotation of the cam.

The switching controlling device may apply the applied duty value which is sequentially decreased until the locking pin is released.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

The technical scope of the present invention is to provide a method and a system capable of preventing a CVVT itself including a cam from being shaken by rotating the cam in a direction which is opposite to a target rotation direction when a releasing process in which a locking pin looses from the locking pin hole is completed.

Figure 4:
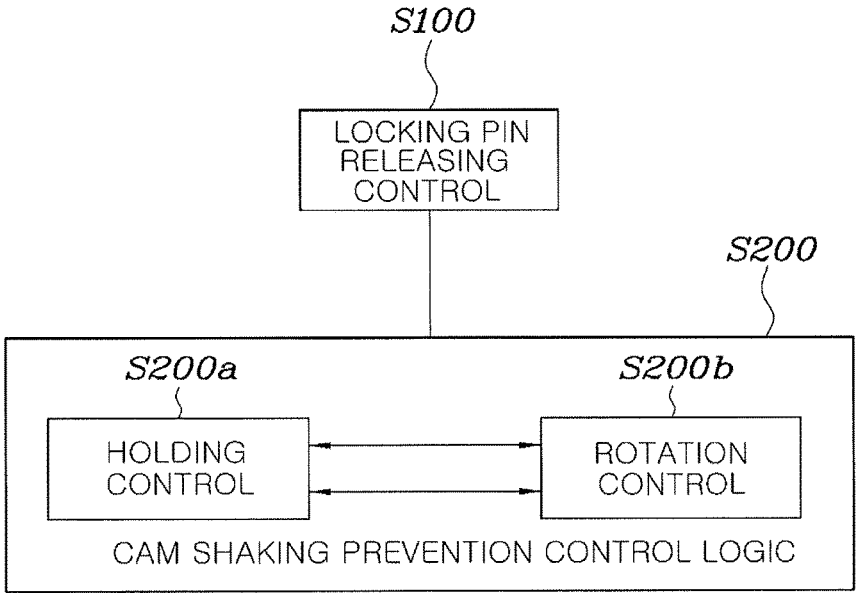
FIG. 4 is an overall flow chart of an exemplary method for releasing a catching of a locking pin according to the present invention.

FIG. 4 is an overall flow chart of a method for releasing a catching of a locking pin according to various embodiments of the present invention.

As shown, the present invention mainly includes a control application (S100) for releasing the locking pin from the locking pin hole, and a cam shaking prevention control logic (S200) including a holding control (S200*a*) and a rotation control (S200*b*) at the same time.

First, the control application (S100) for releasing the locking pin from the locking pin hole is performed. This may be performed by transmitting a signal applying an electrical signal to a solenoid valve from an ECU so that the locking pin may be vertically moved along the locking pin hole, and the locking pin may be released from the locking pin hole by alternately rotating the CVVT itself including the cam in advance and retard directions to thereby remove so called 'side force' caught with the locking pin.

However, as described above, in the case in which the CVVT itself including the cam is alternately rotated in the advance and retard directions as described above, the cam is rotated in a direction which is opposite to a rotation direction of the cam which is actually targeted in the instant at which the locking pin is actually loosed from the locking pin hole, such that the CVVT itself including the cam may be shaken.

In order to solve the above-mentioned problem, the present invention performs the control application for releasing the locking pin from the locking pin hole and performs the cam shaking prevention control logic S200 implemented by alternately switching the holding control S200*a* and the rotation control S200*b* at the same time.

The holding control S200*a* is a control stopping the cam without rotating the cam in any direction of a target direction or a direction which is opposite to the target direction and the rotation control S200*b* is a control rotating the cam in the target rotation direction of the cam. Hereinafter, although the holding control S200*a* and the rotation control S200*b* will be described in detail, they are alternately performed at a set period, the releasing that the locking pin is loosed from the locking pin hole is implemented during the performing process, and the cam is rotated in the rotation target direction when the releasing is implemented. As a result, the problem that the CVVT itself including the cam is shaken because the cam is rotated in the direction which is opposite to the rotation target direction in the instant at which the locking pin is released as in the related art may be prevented in advance.

Figure 5:
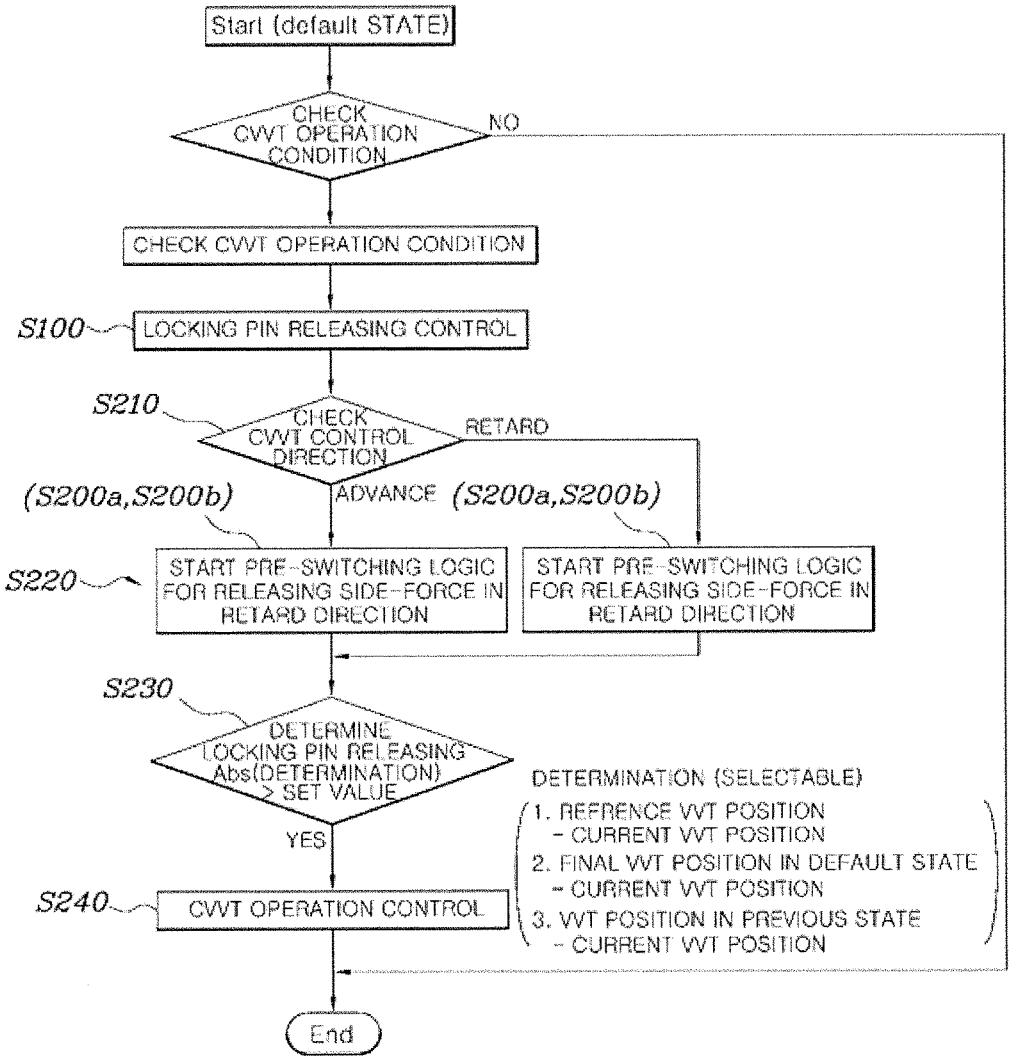
FIG. 5 is a flow chart specifically showing a cam shaking prevention control logic according to the present invention.

Meanwhile, FIG. 5 is a flow chart specifically showing the above-mentioned cam shaking prevention control logic (S200). Hereinafter, the cam shaking prevention control logic (S200) will be described with reference to the drawings.

The cam shaking prevention control logic (S200) according to an exemplary embodiment of the present invention mainly includes a direction searching step (S210), a locking pin friction force removing step (S220), and a step (S240) of controlling the cam in the rotation target direction.

First, the direction searching step (S210) is a process in which it is searched whether the cam is rotated in any direction of the advance or retard direction by a rotation target value which is set by a process confirming a control direction of the CVVT.

After the above-mentioned direction searching step (S210), the locking pin friction force removing step (S220) is performed. This locking pin friction force removing step (S220) has technical characteristic that the holding control (S200*a*) and the rotation control (S200*b*) are alternately performed by the set period value as described above.

That is, as shown, when the searching is performed in the advance direction or the retard direction, a control process for releasing friction force or 'side force' is performed. Since the cam does not arrive at the target value despite the rotating of the cam in a state in which the friction force or 'side force' is continuously applied to the locking pin, the holding control (S200*a*) is first performed so that the cam is not rotated.

The holding control (S200*a*) stops a rotation of the cam by not applying a duty value rotating the cam. In general, since the cam is rotated by transmitting an oil supplying signal to an oil control valve (OCV) from the ECU to supply oil in the advance or retard direction, the holding control (S200*a*) is a process of stopping the rotation of the cam by not temporarily transmitting the oil supplying signal to the oil control valve.

Meanwhile, the rotation control (S200*b*) has technical characteristic in which it applies a set duty value so that the cam is rotated in the rotation target direction of the cam. Since the rotation of the cam also transmits the signal for supplying the oil to the oil control valve from the ECU, the rotation control (S200*b*) transmits the duty value which is set to rotate the cam in the rotation target direction of the cam to the oil control valve from the ECU together with the holding control (S200*a*).

In this case, since the holding control S200*a* and the rotation control S200*b* are alternately performed by the set period value during a process (S100) in which the releasing control is also applied to the locking pin, the releasing step in which the locking pin is gradually loosed from the locking pin hole is again performed during the process in which the holding control (S200*a*) and the rotation control (S200*b*) are alternately performed.

That is, even during the process in which the holding control (S200*a*) is performed, the releasing of the locking pin is performed by force by which the lock pin is loosed from the locking pin hole. In this case, if the locking pin is in a state in which it is still caught with the locking pin hole, the rotation control (S200*b*) again rotating the cam in the rotation target direction by the set duty value is performed and the holding control (S200*a*) is performed after a time corresponding to a predetermined period value lapses, thereby finally completing the releasing of the locking pin.

Meanwhile, the technical characteristic of the present invention is that the duty value applied to the cam upon the rotation control is smaller than the target duty value set to rotate the cam in the rotation target direction of the cam so that the process in which the locking pin is loosed from the locking pin hole is smoothly performed during the process in which the holding control (S200*a*) and the rotation control (S200*b*) are alternately performed by the set period value as described above.

For example, in the case in which the set target duty value is 50%, the duty value applied to the cam upon the rotation control is applied by 48% or 47% which is smaller than 50%.

The reason is that since the set target duty value is the duty value that the locking pin has to have in the instant at which the locking pin is released from the locking pin hole, in the case in which the duty value applied to the cam during the process in which the locking pin is released corresponds to the set target duty value, the friction force or 'side force' may be increased.

More preferably, the duty value applied to the cam upon the rotation control may be sequentially decreased until the locking pin is released from the locking pin hole.

That is, it is preferable to guide the locking pin to be smoothly released from the locking pin hole by gradually decreasing the duty value applied to the cam during the process in which the locking pin is released.

Figure 6:
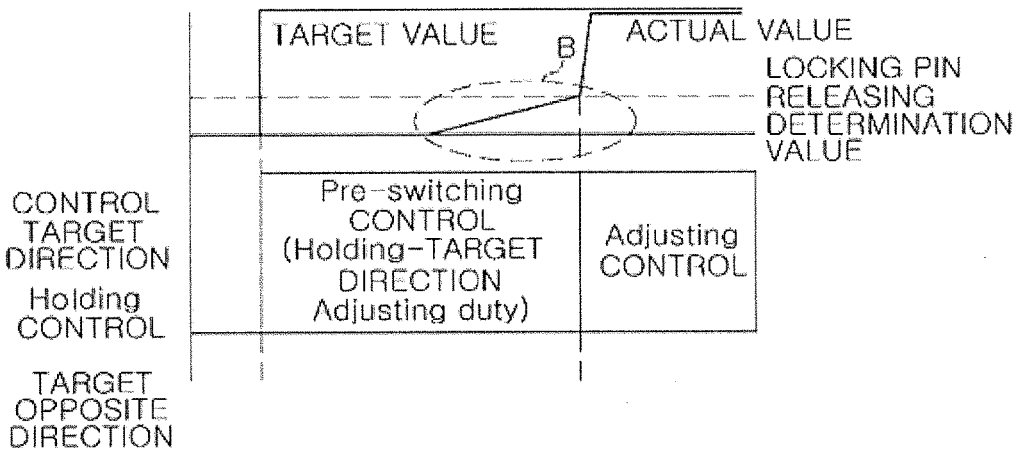
FIG. 6 is a diagram showing a state in which the locking pin is released by the cam shaking prevention control logic according to the present invention.

Meanwhile, FIG. 6 is a diagram showing a state in which the locking pin is released by the cam shaking prevention control logic (S200) described above.

Figure 1:
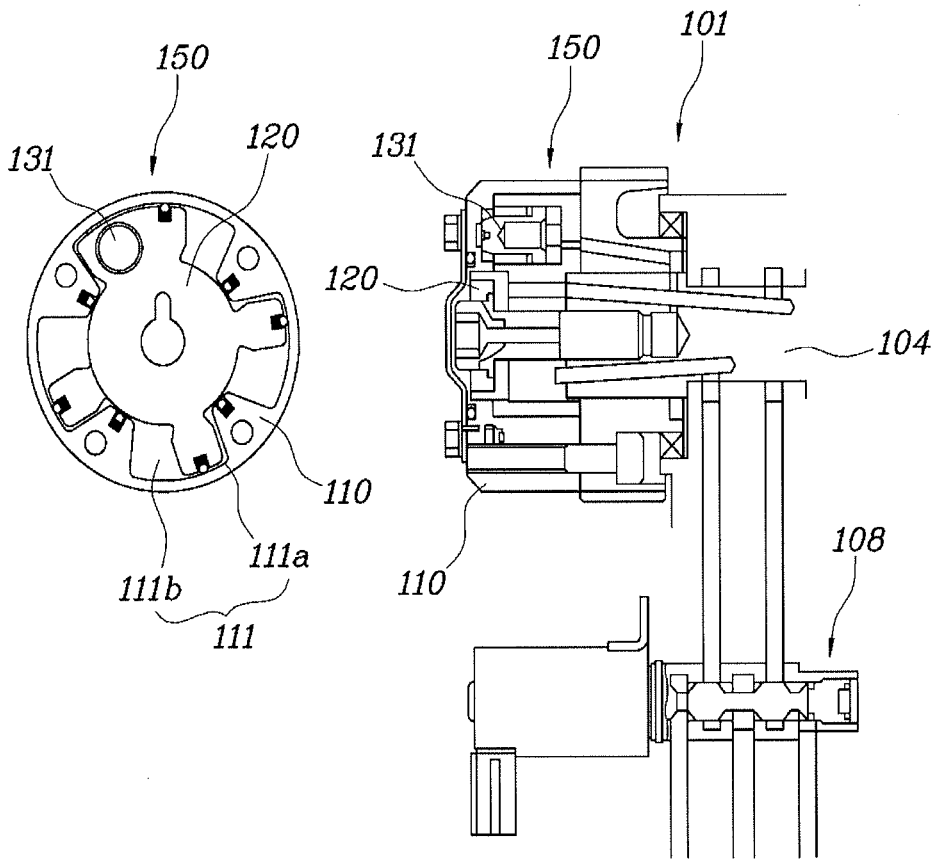
FIG. 1 (Related Art)
FIG. 1 is a configuration diagram of a general continuous variable valve timer according to the related art.
Figure 2A:
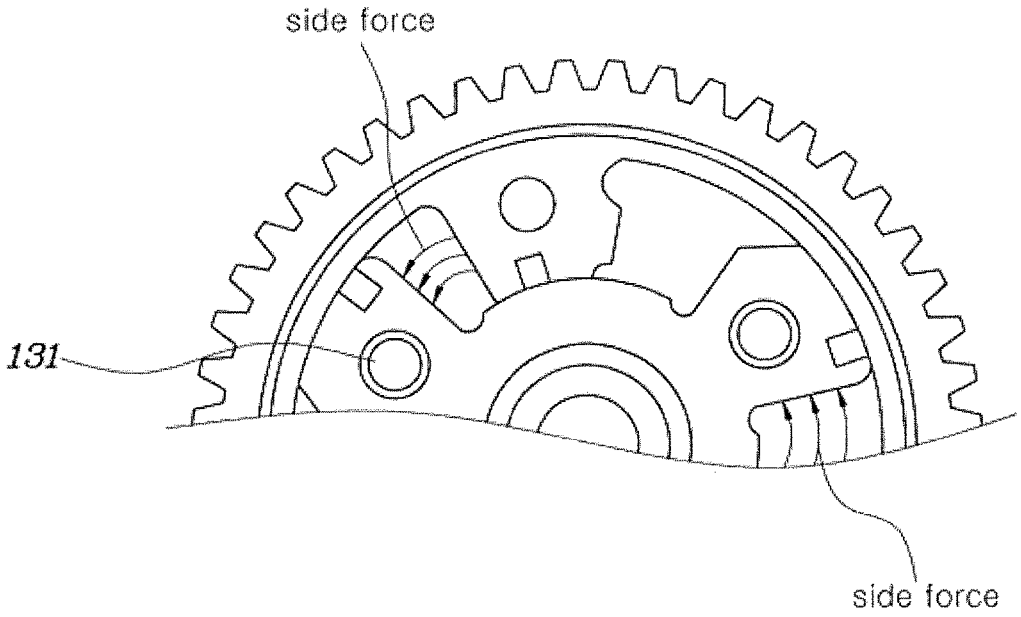
FIG. 2A (Related Art)
FIG. 2A and FIG. 2B are state views showing a problem that a locking pin according to the related art is caught with a locking pin hole by a control of a CVVT.
Figure 2B:
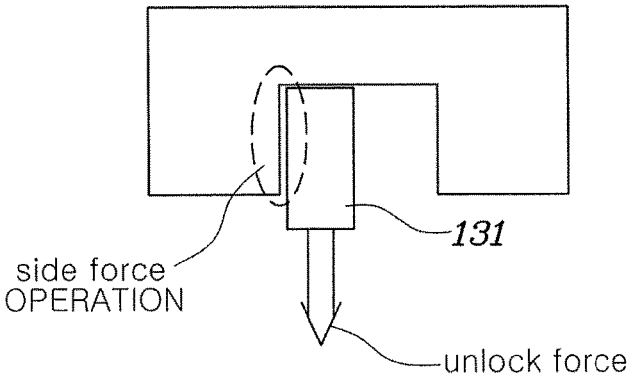
FIG. 2B (Related Art)
Figure 3:
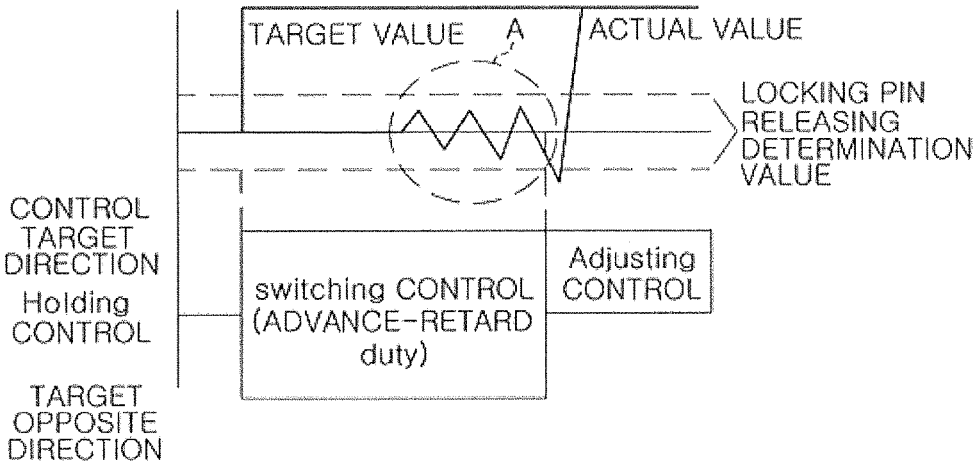
FIG. 3 (Related Art)
FIG. 3 is a diagram showing a phenomenon in which the CVVT shakes in a direction which is opposite to a target direction of the CVVT when the locking pin is released.

Again, it may be appreciated from the region 'A' shown in FIG. 3 that the cam arrives at the target value while being vibrated during a process in which the locking pin arrives at a releasing determination value, and it may be appreciated that the rotation direction of the cam is opposite to the target direction even in the instant at which the locking pin actually arrives at the releasing determination value.

However, as shown in a region 'B' of FIG. 6, according to an exemplary embodiment of the present invention, it may be appreciated that the cam is moved to the same direction as the target direction until the locking pin arrives at the releasing determination value, a phenomenon in which the cam is vibrated is also not founded, and the rotation direction of the cam is also the same as the target direction even in the instant in which the locking pin actually arrives at the releasing determination value.

Meanwhile, again referring to FIG. 5, the present invention further includes, after the locking pin friction force removing step (S220), a locking pin releasing determining step (S230) of determining that the releasing of the locking pin is completed in the case in which a difference between a position of a current cam and a position of a cam is greater than a set reference value.

Of course, in addition to the above-mentioned determination, it is possible to determine that the locking pin is released even in the case in which a difference between 'a position of a final cam in a default state' and 'the position of the current cam' is greater than the set reference value, and the case in which a difference between 'a position of a cam in a previous state and 'the position of the current cam' is also greater than the set reference value.

Figure 7:
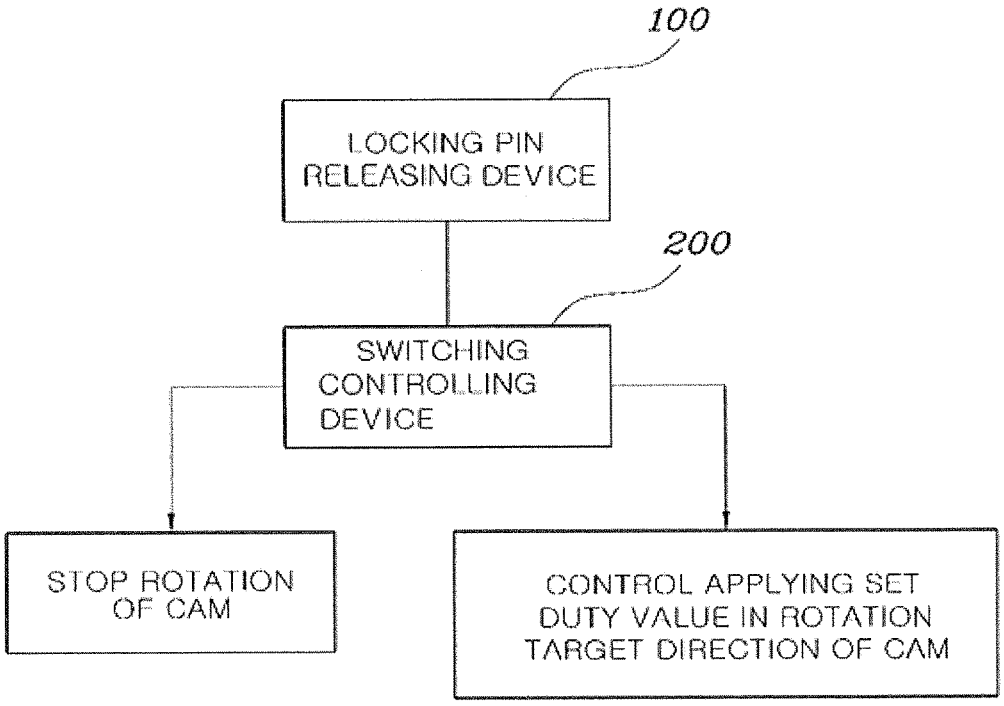
FIG. 7 is an overall configuration diagram of an exemplary system for releasing a catching of a locking pin according to the present invention.

Meanwhile, FIG. 7 is an overall configuration diagram of a system for releasing a catching of a locking pin according to various embodiments of the present invention.

As shown, the system for releasing the catching of the locking pin according to various embodiments of the present invention mainly includes a locking pin releasing device 100 applying a signal releasing the locking pin and a switching controlling device 200 alternately performing a releasing control by the locking pin releasing device 100, and a control stopping a rotation of a cam and a control applying a set duty value in a rotation target direction of the cam at the same time.

In this case, the switching controlling device 200 searches a rotation target direction of the cam, alternately performs the control stopping the rotation of the cam and the control applying the set duty value in the rotation target direction of the cam by a set period value, and then applies a signal rotating the cam in the rotation target direction of the cam after the locking pin is released.

In addition, the switching controlling device 200 does not apply the duty value rotating the cam upon the control stopping the rotation of the cam, and alternately applies a duty value smaller than the target duty value applied in the rotation target direction of the cam together with the control stopping the rotation of the cam.

More preferably, the switching controlling device 200 may apply the applied duty value which is sequentially decreased until the locking pin is released.

Meanwhile, since an operation process of the system for releasing the catching of the locking pin according to an exemplary embodiment of the present invention having the above-mentioned configuration is already described, it will be omitted herein.

According to various embodiments of the present invention, the method and the system for releasing the catching of the locking pin having the above-mentioned configuration solve the problems such as responsibility degradation, operability decrease, start off, startability defect, and the like and the stick of the locking pin is solved though the driver does not directly go to the repair shop, thereby making it possible to optimize effect of the system of the CVVT, and so forth.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method for releasing a catching of a locking pin, the method comprising:

a control application step of releasing the locking pin from a locking pin hole by an electronic control unit (ECU) so that a catching phenomenon of the locking pin due to friction force into a rotation direction of a cam is prevented; and a cam shaking prevention control logic repetitively performing, by the ECU, a holding control by stopping a rotation of the cam and a rotation control by rotating the cam only in a same target direction excluding a reverse direction thereof, during a process of repetitively performing the control application step by performing stopping and rotating of the cam in the same target direction, so that the cam is prevented to rotate in the reverse direction which is opposite to the same target direction of the cam until the releasing of the locking pin is completed.

2. The method of claim 1, wherein the cam shaking prevention control logic includes:

a direction searching step of searching the same target direction of the cam;

a locking pin friction force removing step of repetitively performing the holding control and the rotation control by a set period value; and a step of controlling the cam in the same target direction of the cam.

3. The method of claim 2, wherein, in the locking pin friction force removing step, the holding control stops the rotation of the cam by not applying a duty value rotating the cam.

4. The method of claim 2, wherein, in the locking pin friction force removing step, the rotation control applies a set duty value so that the cam is rotated in the same target direction of the cam.

5. The method of claim 4, wherein the set duty value is smaller than a target duty value which is set to rotate the cam in the same target direction of the cam.

6. The method of claim 5, wherein the set duty value has an applied duty value which is gradually decreased until the locking pin is released from the locking pin hole.

7. The method of claim 3, further comprising:

after the locking pin friction force removing step, a locking pin releasing determining step of determining that the releasing of the locking pin is completed in a case in which a difference between a position of a current cam and a position of the cam at which the locking pin was caught is greater than a set reference value.

8. A system for releasing a catching of a locking pin, the system comprising:

a locking pin releasing device applying a signal releasing the locking pin; and a switching controlling device repetitively performing, a control stopping a rotation of a cam and a control applying a set duty value only in a same rotation target direction of the cam excluding a reverse direction thereof during repetitively performing stopping and rotating of the cam in the same target direction, so that the cam is prevented to rotate in a reverse direction which is opposite to the same rotation target direction of the cam until releasing of the locking pin is completed.

9. The system of claim 8, wherein the switching controlling device searches the same rotation target direction of the cam, repetitively performs the control stopping the rotation of the cam and the control applying the set duty value in the same rotation target direction of the cam by a set period value, and then applies a signal rotating the cam in the same rotation target direction of the cam after the locking pin is released.

10. The system of claim 9, wherein the switching controlling device does not apply a duty value rotating the cam upon the control stopping the rotation of the cam.

11. The system of claim 10, wherein the switching controlling device alternately applies a duty value smaller than the target duty value applied in the same rotation target direction of the cam together with the control stopping the rotation of the cam.

12. The system of claim 11, wherein the switching controlling device applies the applied duty value which is sequentially decreased until the locking pin is released.

* * * * *